US009024214B2

(12) United States Patent
Niu et al.

(10) Patent No.: US 9,024,214 B2
(45) Date of Patent: May 5, 2015

(54) NARROW KEY SWITCH

(75) Inventors: James J. Niu, San Jose, CA (US); Harold J. Welch, San Jose, CA (US); Chad Bronstein, San Jose, CA (US); Patrick Kessler, San Francisco, CA (US); Chris Ligtenberg, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 686 days.

(21) Appl. No.: 12/814,010

(22) Filed: Jun. 11, 2010

(65) Prior Publication Data

US 2011/0303521 A1 Dec. 15, 2011

(51) Int. Cl.
*H01H 13/70* (2006.01)
*H01H 3/12* (2006.01)

(52) U.S. Cl.
CPC ..... *H01H 3/122* (2013.01); *H01H 3/125* (2013.01); *H01H 2215/012* (2013.01)

(58) Field of Classification Search
CPC ..... H01H 3/125
USPC ..... 200/5 A, 517, 344, 345; 400/490–496
See application file for complete search history.

(56) References Cited

U.S. PATENT DOCUMENTS 5,874,696 A * 2/1999 Hayashi et al. ..... 200/5 A
6,100,482 A * 8/2000 Koma et al. ..... 200/344
6,222,527 B1 * 4/2001 Hu ..... 345/168
6,278,442 B1 * 8/2001 Griffin et al. ..... 345/169
6,399,909 B1 * 6/2002 Okada ..... 200/344
6,509,536 B2 * 1/2003 Sasaki ..... 200/344

(Continued)

FOREIGN PATENT DOCUMENTS

CN 1315738 A 10/2001
CN 1487393 A 4/2004

(Continued)

OTHER PUBLICATIONS

Notification to Grant the Patent Right for Chinese Patent Application Utility Model No. ZL201120193066.9 dated Jan. 10, 2012.

(Continued)

*Primary Examiner* — Renee S Luebke
*Assistant Examiner* — Ahmed Saeed
(74) *Attorney, Agent, or Firm* — Brownstein Hyatt Farber Schreck, LLP

(57) ABSTRACT

A narrow key switch for a low travel keyboard and methods of fabrication are described. The low-travel keyboard having narrow keys is suitable for a thin-profile computing device, such as a laptop computer, netbook computer, desktop computer, etc. The keyboard includes a key cap positioned over an elastomeric dome and a two-part scissor mechanism having two separate linkage structures on opposite sides of the dome. A link bar is also provided to transfer a load from a side of a key to the center if the key cap is depressed in an off-center manner. Transferring the load to the center helps to deform the elastomeric dome so that it can activate the switch circuitry of the membrane on printed circuit board underneath the dome. Separating the linkage structures into two separate parts allows for the use of a full-sized elastomeric dome for a narrow key switch. The full-sized dome provides the desired tactile feedback to a user. Thus, the tactile feel of the key is not compromised even thought the key is narrower than a conventional key.

14 Claims, 13 Drawing Sheets

(56) References Cited

U.S. PATENT DOCUMENTS

| | | | | |
|---|---|---|---|---|
| 6,730,868 | B1 | 5/2004 | Watanabe | |
| 6,864,449 | B2 | 3/2005 | Ito | |
| 6,936,782 | B2 * | 8/2005 | Ito | 200/344 |
| 7,094,984 | B2 * | 8/2006 | Yokoyama | 200/344 |
| 7,196,282 | B2 * | 3/2007 | Mitsuoka et al. | 200/516 |
| 7,199,320 | B2 * | 4/2007 | Sato | 200/341 |
| 7,288,733 | B2 * | 10/2007 | Yamada et al. | 200/5 A |
| 7,319,202 | B2 * | 1/2008 | Sato | 200/344 |
| 2004/0178051 | A1 | 9/2004 | Sato | |
| 2006/0096847 | A1 * | 5/2006 | Nishimura et al. | 200/406 |
| 2007/0158172 | A1 * | 7/2007 | Yatsu et al. | 200/344 |
| 2007/0199804 | A1 * | 8/2007 | Joseph et al. | 200/5 A |
| 2008/0159799 | A1 * | 7/2008 | Bender et al. | 400/472 |
| 2010/0025213 | A1 * | 2/2010 | Li | 200/344 |
| 2010/0232861 | A1 * | 9/2010 | Shibata et al. | 400/491 |
| 2011/0226600 | A1 * | 9/2011 | Lo et al. | 200/5 A |

FOREIGN PATENT DOCUMENTS

| | | | |
|---|---|---|---|
| CN | 1530802 | A | 9/2004 |
| CN | 1700376 | A | 11/2005 |
| CN | 1790576 | | 6/2006 |
| CN | 101026045 | A | 8/2007 |
| JP | 11-16440 | A | 1/1990 |
| TW | 568304 | | 12/2003 |
| TW | M354115 | | 4/2009 |

OTHER PUBLICATIONS

Office Action (and English translation) in corresponding Chinese Application No. 201120193066.9, mailed Sep. 29, 2011.

Notification to Grant the Patent Right for Chinese Patent Application Utility Model No. ZL201220091483.7 dated Aug. 9, 2012.

Evaluation Report of Utility Model Patent No. ZL201120193066.9 dated May 7, 2012.

Office Action dated Feb. 13, 2014, in CN 201110155086.1, 9 pages.

Office Action dated Jan. 20, 2014, in TW 10116688, 9 pages.

* cited by examiner

REPLACEMENT SHEET

NARROW KEY SWITCH

BACKGROUND OF THE INVENTION

1. Field of the Invention

The described embodiments relate generally to peripheral devices for use with computing devices and similar information processing devices. More particularly, the present embodiments relate to keyboards for computing devices and methods of assembling the keyboards of computing devices.

2. Description of the Related Art

Keyboards are used to input text and characters into the computer and to control the operation of the computer. Physically, computer keyboards are an arrangement of rectangular or near-rectangular buttons or "keys," which typically have engraved or printed characters. In most cases, each depressing of a key corresponds to a single symbol. However, some symbols require that a user depresses and holds several keys simultaneously, or in sequence. Depressing and holding several keys simultaneously, or in sequence, can also result in a command being issued that affects the operation of the computer, or the keyboard itself.

There are several types of keyboards, usually differentiated by the switch technology employed in their operation. The choice of switch technology affects the keys' responses (i.e., the positive feedback that a key has been depressed) and travel (i.e., the distance needed to push the key to enter a character reliably). One of the most common keyboard types is a "dome-switch" keyboard, which works as described below. When a key is depressed, the key pushes down on a rubber dome sitting beneath the key. The rubber dome collapses, which gives tactile feedback to the user depressing the key, and pushes down on a membrane, thereby causing contact pads of circuit traces on different layers of the membrane to connect and close the switch. A chip in the keyboard emits a scanning signal along the pairs of lines on the PCB to all the keys. When the signal in one pair of lines changes due to the contact, the chip generates a code corresponding to the key connected to that pair of lines. This code is sent to the computer either through a keyboard cable or over a wireless connection, where it is received and decoded into the appropriate key. The computer then decides what to do based on the particular key depressed, such as display a character on the screen, or perform some other type of action. Other types of keyboards operate in a similar manner, with the main difference being how the individual key switches work. Some examples of other keyboards include capacitive keyboards, mechanical-switch keyboards, Hall-effect keyboards, membrane keyboards, roll-up keyboards, and so on.

The outward appearance, as well as functionality, of a computing device and its peripheral devices is important to a user of the computing device. In particular, the outward appearance of a computing device and peripheral devices, including their design and its heft, is important, as the outward appearance contributes to the overall impression that the user has of the computing device. One design challenge associated with these devices, especially with portable computing devices, generally arises from a number conflicting design goals that includes the desirability of making the device smaller, lighter, and thinner while maintaining user functionality.

Therefore, it would be beneficial to provide a keyboard for a portable computing device that is small and aesthetically pleasing, yet still provides the tactile feel to which users are accustomed. It would also be beneficial to provide methods for manufacturing the keyboard having a smaller footprint for the portable computing device.

SUMMARY OF THE DESCRIBED EMBODIMENTS

This paper describes various embodiments that relate to systems, methods, and apparatus for providing narrow keys for a reduced footprint keyboard that provides tactile feedback for use in computing applications.

According to one embodiment, a reduced footprint keyboard for a computing device is described. The keyboard includes a key cap disposed over an elastomeric dome that can activate electrical switch circuitry below the dome when the dome is deformed. A two-part movable scissor mechanism is also provided underneath the key cap, linking the key cap and a base plate. The scissor mechanism includes two separate slidable linkage structures positioned on opposite sides of the dome. In an embodiment, the key cap deforms the elastomeric dome and also causes one end of the linkage structures to slide when a user pushes down on the key cap. A link bar is also rotatably engaged with the key cap and can transfer a load from a side of a key to the center so that the dome can be adequately deformed to activate the switch circuitry even if the key cap is depressed on an edge. The separate linkage structures of the scissor mechanism allow for the use of a full-sized elastomeric dome even though the key is narrower than a conventional key. The full-sized dome can provide a positive tactile response for the user and the separate linkage structures reduce the footprint of the keyboard.

A method of assembling the key switch is disclosed. The method can be carried out by the following operations: providing a membrane having electrical switch circuitry, disposing a elastomeric dome over the membrane, disposing two separate linkage structures of a two-part scissor mechanism on opposite sides of the elastomeric dome, and positioning a key cap engaged with a link bar over the elastomeric dome. The link bar provides additional mechanical stability. The elastomeric dome is positioned over the membrane such that the dome contacts the membrane to close the switch when the dome is deformed.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF SELECTED EMBODIMENTS

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as may be included within the spirit and scope of the described embodiments as defined by the appended claims.

Figure 1:
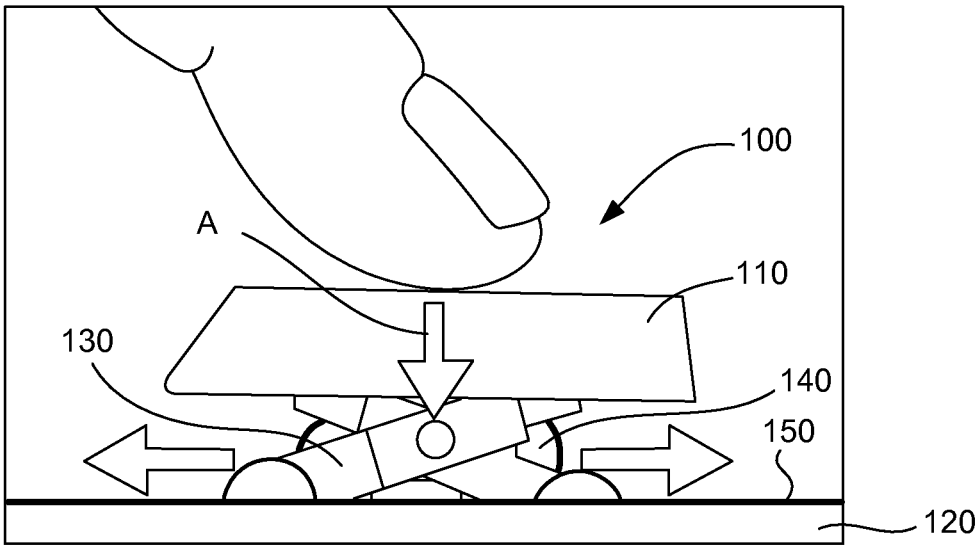
FIG. 1 is a side view of a typical key switch of a scissor-switch keyboard.

FIG. 1 is a side view of a typical key switch 100 of a scissor-switch keyboard. A scissor-switch keyboard is a type of relatively low-travel dome-switch keyboard that provides the user with good tactile response. Scissor-switch keyboards typically have a shorter total key travel distance, which is about 1.5-2 mm per key stroke instead of about 3.5-4 mm for standard dome-switch key switches. Thus, scissor-switch type keyboards are usually found on laptop computers and other "thin-profile" devices. The scissor-switch keyboards are generally quiet and require relatively little force to press.

As shown in FIG. 1, the key cap 110 is attached to the base plate or PCB 120 of the keyboard via a scissor-mechanism 130. The scissor-mechanism 130 includes two pieces that interlock in a "scissor"-like manner, as shown in FIG. 1. The scissor-mechanism 130 is typically formed of a rigid material, such as plastic or metal or composite material, as it provides mechanical stability to the key switch 100. As illustrated in FIG. 1, a rubber dome 140 is provided. The rubber dome 140, along with the scissor-mechanism 130, supports the key cap 110.

When the key cap 110 is pressed down by a user in the direction of arrow A, it depresses the rubber dome 140 underneath the key cap 110. The rubber dome 140, in turn, collapses, giving a tactile response to the user. The scissor-mechanism 130 also transfers the load to the center to collapse the rubber dome 140 when the key cap 110 is depressed by the user. The rubber dome also dampens the keystroke in addition to providing the tactile response. The rubber dome 140 can contact a membrane 150, which serves as the electrical component of the switch. The collapsing rubber dome 140 closes the switch when it depresses the membrane 150 on the PCB, which also includes a base plate 120 for mechanical support. The total travel of a scissor-switch key is shorter than that of a typical rubber dome-switch key. As shown in FIG. 1, the key switch 100 includes a three-layer membrane 150 (on a PCB) as the electrical component of the switch. The membrane 150 can be a three-layer membrane or other type of PCB membrane, which will be described in more detail below.

The following description relates to a narrow key for a low-travel keyboard suitable for a small, thin-profile computing device, such as a laptop computer, netbook computer, desktop computer, etc. The use of narrow keys allows for a reduced footprint for the keyboard and the computing device. Typically, keys, such as those described with reference to FIG. 1 above, are substantially square in shape. A typical square-shaped key of a laptop computer has sides that are about 15 mm long. Narrow, rectangular keys can be provided for keys that are used less frequently. Such keys can include function keys and arrow keys. Function and arrow keys can be positioned, for example, at the top row of a keyboard or in a lower right corner.

These and other embodiments of the invention are discussed below with reference to FIGS. 2-13. However, those skilled in the art will readily appreciate that the detailed description given herein with respect to these figures is for explanatory purposes as the invention extends beyond these limited embodiments.

Figure 2:
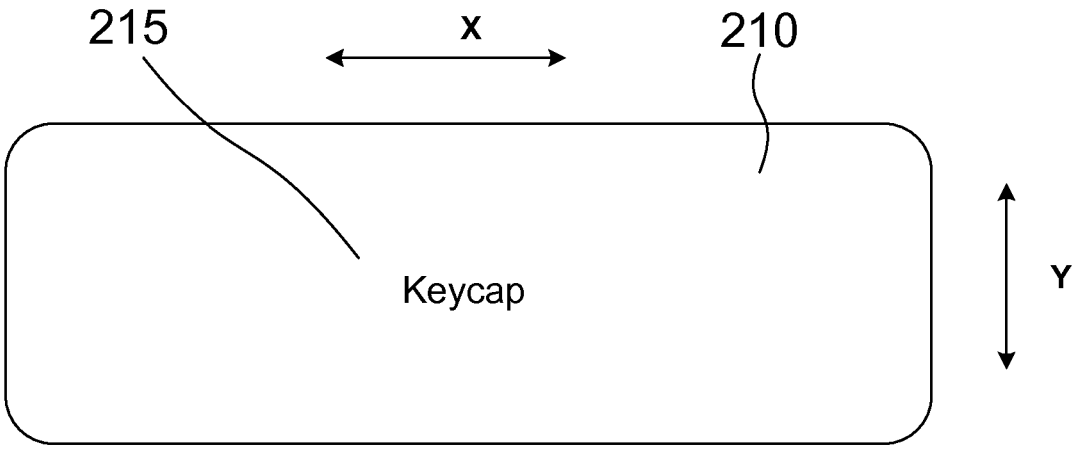
FIG. 2 is a top plan view of a narrow, rectangular key cap.

A top plan view of a narrow, rectangular key cap 210 is shown in FIG. 2. For narrow, rectangular keys, such as function keys and arrow keys used in desktop or laptop keyboards, the longitudinal dimension (usually referred to as the X dimension) can be several times the transverse dimension (referred to as the Y dimension). The up and down direction of the key cap 210 is usually referred to as the Z dimension, as shown in FIG. 3.

The keyboard can include a key cap 210, such as the one shown in FIG. 2, positioned over an elastomeric dome. The key cap 210 can be formed of plastic materials, such as, for example, acrylonitrile butadiene styrene (ABS) or polycarbonate (PC). In some embodiments, the key cap 210 is surface-marked. In other embodiments, the key cap 210 can be laser-cut, two-shot molded, engraved, or formed of transparent material with printed inserts 215. The elastomeric dome can be formed of an elastomeric material, such as silicone.

Figure 3:
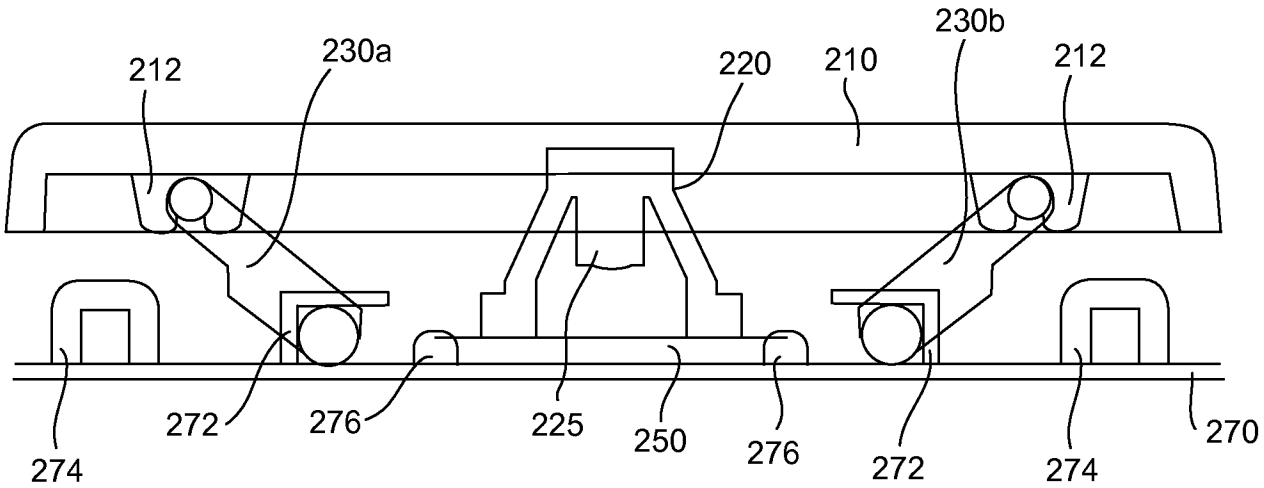
FIG. 3 is a side view of an embodiment of a narrow key switch of a scissor-switch keyboard.

FIG. 3 is a side view of an embodiment of a narrow key switch 200 of a scissor-switch keyboard having an elastomeric dome underneath a key cap 210. According to an embodiment, the key switch 200 has a travel distance of less than about 1.25 mm, with a peak force in the range of about 45 grams to about 75 grams. According to another embodiment, the key switch 200 has a travel distance of about 1.25 mm, with a peak force in a range of about 50 grams to about 70 grams. In other embodiments, the key switch 200 has a total travel of less than about 1.25 mm. In some other embodiments, the key switch 200 has a total travel in a range of about 1 mm to about 1.25. In still other embodiments, the key switch 200 has a total travel in a range of about 1.25 mm to about 1.5 mm. It will be understood that it may be desirable for the narrow key switch 200 to have a shorter travel distance than other larger keys of the keyboard in order to accommodate an appropriately sized dome 220.

According to the embodiments shown in FIGS. 2-13, an elastomeric or rubber dome is positioned over the base plate 270. The elastomeric dome provides a positive tactile feedback that is desirable for a keyboard, as will be explained in more detail below. According to this embodiment, the key has a travel distance of less than about 1.25 mm. As shown in FIG. 3, the dome is substantially concave or hemispherical and oriented such that the vertex of the dome is at the highest point. In other words, the elastomeric dome is positioned with the dome opening facing downward. As the dome is concave, it is a normally-open tactile switch. The switch only closes when the dome is collapsed, as will be described in more detail below. It will be understood that although the illustrated embodiments show a substantially hemispherical dome, the elastomeric structure, in other embodiments, may also have other shapes, including, for example, rectangular or box shape, conical, truncated conical, and other shapes capable of similar deformation from the typical force applied to a key pad. In an alternative embodiment, the dome can be formed of a metal material. According to another embodiment, stacked metal and elastomeric domes may be provided in place of a single elastomeric dome. Stacked metal and elastomeric domes are described in U.S. patent application Ser. No. 12/712,102, filed on Feb. 24, 2010, the entirety of which is hereby incorporated herein by reference.

The embodiment illustrated in FIG. 3 also includes a two-part scissor mechanism 230, which includes two separate linkage structures 230*a*, 230*b*. The scissor mechanism 230 is a movable mechanism that links the key cap 210 to the base plate 270.

Additional support and mechanical stability for the key switch can be provided by the scissor mechanism 230 around the X axis. Each linkage structure 230*a*, 230*b* can be as wide as the design allows, in the transverse direction, thereby providing the most stability in the transverse direction, minimizing lateral shift or rocking when the key cap 210 is depressed off-center or with a sideways load (in the transverse direction). In this embodiment, as the key is only about 5-6 mm wide (in the transverse Y direction) and the dome has a diameter of about 3.5-4.0 mm, there is not enough space left around the dome 220 for a traditional scissor mechanism, such as the one shown in FIG. 1. According to another embodiment, the key is only about 5.5 mm wide in the transverse Y direction. According to yet another embodiment, the key is about 4-7 mm wide (in the transverse Y direction) and the dome has a diameter of about 3-5 mm. Therefore, this embodiment of the scissor mechanism 230 is separated into two separate linkage structures 230*a*, 230*b* to provide space for a full-sized dome that can provide the desired tactile feeling to the user. The full-sized dome will also allow the dome to have a reasonable life because a smaller dome with the same travel distance usually experiences a greater amount of stress. As shown in FIG. 3, the two separate linkage structures 230*a*, 230*b* of the scissor mechanism 230 are positioned on opposite sides of the elastomeric dome 220. The two separate linkage structures 230*a*, 230*b* are not connected or attached to each other.

Figure 4:
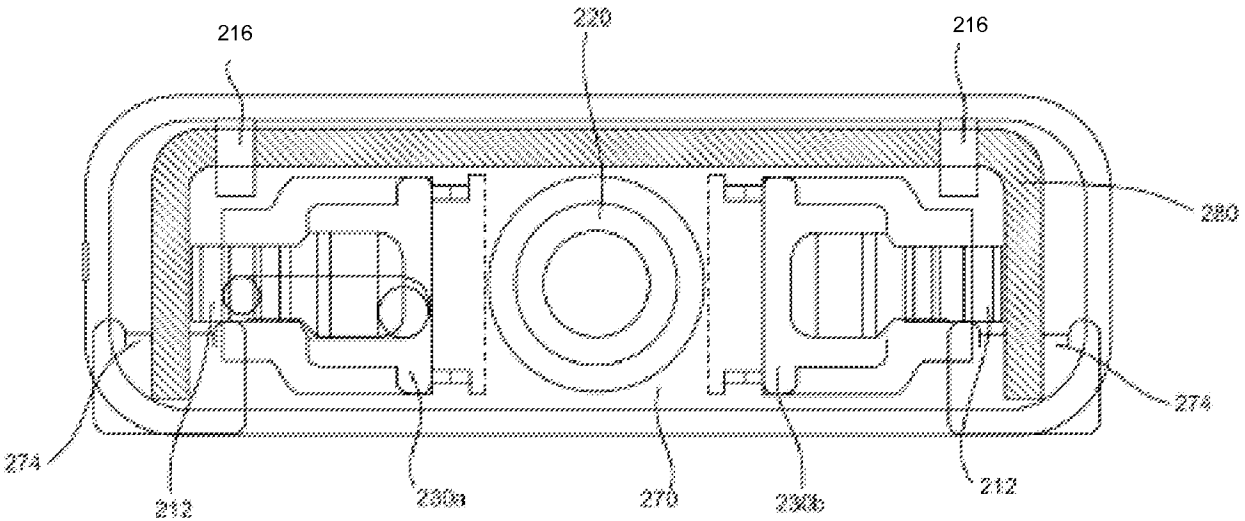
FIG. 4 is a top down view showing the internal structures of the key switch.

The scissor mechanism 230 can also maintain the desired key cap 210 height relative to the base plate 270. In other words, the scissor mechanism helps to maintain the desired distance between the key cap 210 and the base plate 270. Each linkage structure 230*a*, 230*b* can also have at least one end that slides when the key cap 210 is pressed down in the Z direction. The dashed lines shown in FIG. 4 illustrate the positions of the sliding ends of the linkage structures 230*a*, 230*b* when the keycap 210 is pressed down in the Z direction. According to an embodiment, the distance that the sliding ends of the linkage structures 230*a*, 230*b* move along the base plate 270 is limited by the stopper 276 of the base plate 270, as shown in FIG. 3.

In the illustrated embodiment, the linkage structures 230*a*, 230*b* are engaged with features 272 of the base plate 270 to engage them with the base plate 270 and define a resting position for the linkage structures 230*a*, 230*b* when the key switch 200 is in a relaxed state. Each of the linkage structures 230*a*, 230*b* can be rotatably engaged with the key cap 210 and slidably engaged with the base plate 270.

In the illustrated embodiment, the upper ends of the linkage structures 230*a*, 230*b* are rotatably engaged with features 212 of the key cap 210. The upper ends of the linkage structures 230*a*, 230*b* can be snapped into features 212 on the underside of the key cap 210. In one embodiment, features 212 are grooves. As shown in FIG. 3, the lower ends of the linkage structures 230*a*, 230*b*, which are closer to the center of the key than the upper ends, are engaged with features 272 of the base plate 270. In other embodiments, such as the one shown in FIG. 8, the scissor mechanism 230 is oriented such that the lower ends of the linkage structures 230*a*, 230*b*, which are closer to the outer sides of the key than the upper ends, are engaged with features 272 of the base plate 270. Features 272 can be hook-shaped structures. As shown in FIG. 3, the lower ends of the linkage structures 230*a*, 230*b* can slide along the base plate 270 when the key cap 210 is depressed by a user. It will be understood that, in this embodiment, the lower ends of the linkage structures 230*a*, 230*b* slide away from features 272 and toward the center of the key when the key cap 210 is depressed.

The scissor mechanism 230 may be formed of a material, such as a plastic resin. In one embodiment, a plastic resin such as polyoxymethylene (POM), may be used to form the scissor mechanism 230. POM has some characteristics that make it a good choice for the material for the scissor mechanism 230. POM can provide the strength necessary for the scissor mechanism 230 to withstand the load from the key cap 210 as the user presses down on the key. POM also has good lubricity, so it functions well as a bearing against materials such as ABS and metal. As the scissor mechanism 230 has a movable linkage structure, the lubricity of POM prevents the scissor mechanism 230 from wearing too quickly. The scissor mechanism, in other embodiments, may be formed of another material, such as metal or composite material, such as glass-filled plastics.

Figure 5:
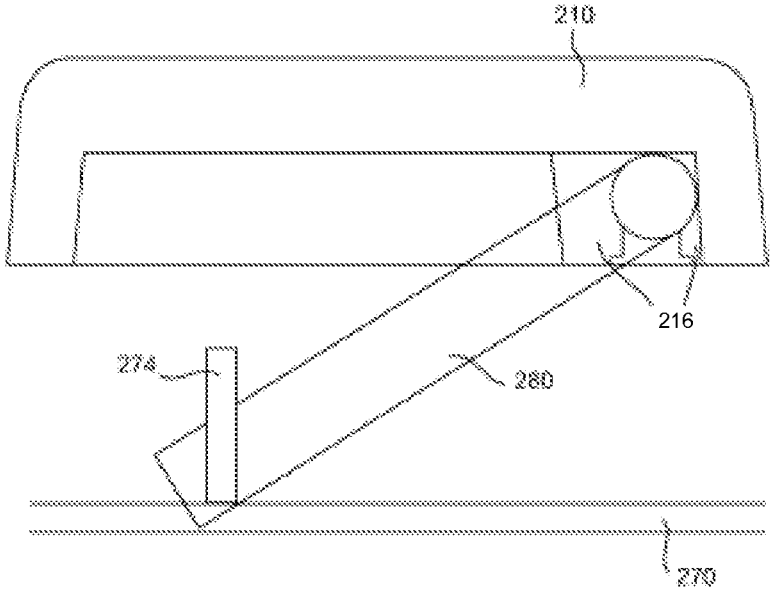
FIG. 5 is a simplified end view showing a link bar and its engagement with the key cap and the base plate.

FIG. 4 is a top down view showing the internal structures of the key switch, including those of the key cap 210, without being obscured by the key cap 210. FIG. 5 is a simplified end view showing a link bar 280 and its engagement with the key cap 210 and the base plate 270. The link bar 280 provides stability in the longitudinal direction by transferring load from one end of the key to the other via torsion. The link bar 280 may be attached to the key cap 210 to transfer the height change in the Z direction from one side of the key to the other if the key is depressed on one side instead of in the center. In other words, the link bar 280 can transfer the torque or load across from the side of the key to the center. It will be appreciated that if the load is not transferred to the center to collapse the elastomeric dome 220, adequate tactile feedback will not be provided. Furthermore, if the key cap 210 is depressed in an off-center manner, the elastomeric dome 220 may not be collapsed enough to close and activate the switch circuitry. In the illustrated embodiment, the link bar 280 can be snapped into features 216 of the key cap 210 and engaged with hooks 274 of the base plate 270. The skilled artisan will appreciate that, as the linkage structures 230*a*, 230*b* of the scissor mechanism are separated and not inter-linked, they do not provide stability around the Y axis. Thus, a link bar 280 can provide additional support and mechanical stability around the Y axis, from one side of the key to the other.

The link bar 280 may be formed of a material, such as stainless steel. Stainless steel has a number of characteristics that make it a good choice for the link bar 280. For example, stainless steel is durable and fairly resistant to corrosion, and it is a relatively inexpensive metal that can be easily machined and has well known metallurgical characteristics. The skilled artisan will appreciate that stainless steel can provide the stiffness necessary for the link bar 280, and because stainless steel can be easily machined, the link bar 280 can be formed with a diameter small enough for the narrow key design. According to some embodiments, the link bar may have a diameter of about 0.5-0.8 mm for a small, narrow key. According to an embodiment, the link bar 280 has a diameter of about 0.6 mm. In an embodiment of a space bar of a keyboard, the link bar may have a diameter of about 0.8 mm. Furthermore, stainless steel can be recycled. As shown in FIGS. 4 and 9-11, the link bar 280 has a length that spans substantially the length of the key. It is desirable for the link bar 280 to span substantially the entire length of the key cap 210 so that the link bar 280 can effectively transfer the load even if the key cap 210 is depressed at an edge. According to an embodiment, the link bar 280 has a length, from one side to the other, of about 12 mm in a 15 mm wide (in the X direction) key.

As shown in FIGS. 4 and 9-11, the link bar 280 extends further to the edges of the key than the linkage structures 230*a*, 230*b*. In other words, the scissor mechanism 230 is positioned between the elastomeric dome 220 and the link bar 280. As illustrated, the linkage structures 230*a*, 230*b* are adjacent the elastomeric dome 220, and the link bar 280 is positioned around the outer periphery of the elastomeric dome 220 and linkage structures 230*a*, 230*b*.

In some embodiments, the link bar 280 may be formed of other rigid materials, such as glass-filled plastics, copper, and other composite materials. It will be understood that the link bar 280 should be formed of a material having sufficient stiffness to provide stability and to transfer the load from a side to the center of the key.

In the illustrated embodiment, the elastomeric dome 220 activates the switch circuitry of the membrane 250 on the base plate 270. When a user presses down on the key cap 210, it depresses and collapses the elastomeric dome 220 and also collapses the scissor mechanism 230. As understood by the skilled artisan, the sliding of the linkage structures 230*a*, 230*b* of the scissor mechanism 230 allow the scissor mechanism 230 to collapse.

As shown in FIG. 3, the elastomeric dome 220 can include a plunger portion 225 that extends downward from the center of the underside of the elastomeric dome 220. The plunger 225 portion of the elastomeric dome 220 is positioned directly over the contact pads 258 (FIG. 12) of the circuit traces of the membrane 250. Thus, when the elastomeric dome 220 compresses, the plunger 225 then contacts and pushes down on the top side of the top layer 252 (FIG. 12) of the membrane 250, thereby causing the contact pads 258 of the circuit traces (FIG. 12) on the top layer 252 (FIG. 12) and the bottom layer 256 (FIG. 12) of the membrane 250 to connect and close the switch, which completes the connection to enter the character or perform the function. As shown in FIG. 3, the plunger 225 is a portion of the elastomeric dome 220 that does not contact the top side of the top layer 252 (FIG. 12) of the membrane 250 when the elastomeric dome 220 is in a relaxed state. As shown in FIG. 3, the membrane 250 is secured to a base plate or PCB 270. It will be understood that the underside of the center of the elastomeric dome 220 does not contact the top side of the top layer 252 (FIG. 12) of the membrane 250 when the elastomeric dome 220 is in a relaxed state.

According to an embodiment, the elastomeric dome 220 has a height in a range of about 2 mm to about 4 mm. According to another embodiment, the elastomeric dome 220 has a height in a range of about 2 mm to about 3 mm. In still another embodiment, the elastomeric dome 220 has a height in a range of about 3 mm to about 4 mm.

In an embodiment, the elastomeric dome 220 has a thickness in a range of about 0.2 mm to about 0.6 mm. It will be understood that the elastomeric dome 220 can have a non-uniform thickness. The skilled artisan will appreciate that the thickness of the dome 220 can be adjusted and/or varied to obtain the desired force drop. The base diameter of the dome 220 can be in the range of about 3 mm to 7 mm, depending on the width of the key cap 210 in the transverse Y direction. In an embodiment, the base diameter of the dome 220 is in a range of about 3.5-4.0 mm.

According to an embodiment, as shown in FIG. 3, the elastomeric dome 220 can be secured, at its base in its non-concave portions, to the membrane 250 by means of adhesive, including pressure-sensitive adhesive tape. The scissor mechanism 230 can be secured to the base plate 270. In one embodiment, each of the linkage structures 230*a*, 230*b* of the scissor mechanism 230 has a locking feature that can be snapped into a corresponding feature 272 in the base plate 270, as shown in FIG. 3.

Figure 6:
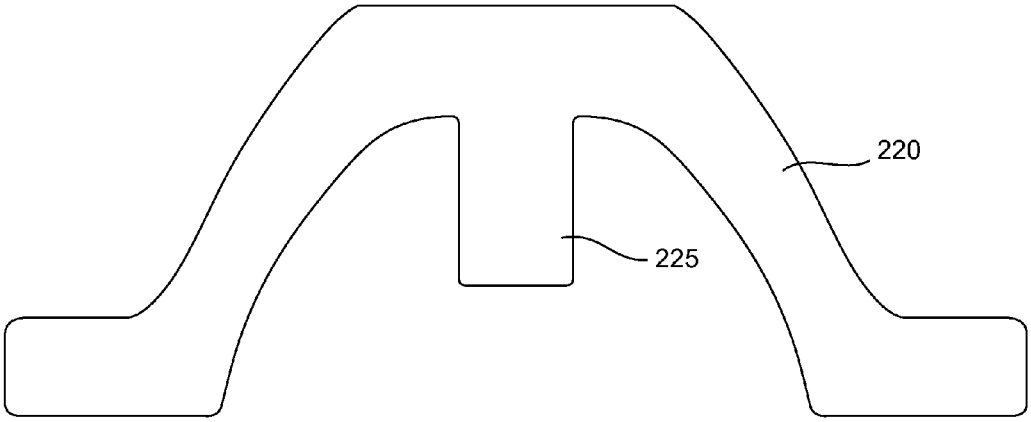
FIG. 6 is a side view of an alternative embodiment of an elastomeric dome.

An alternative design for the elastomeric dome 220 is illustrated in FIG. 6. The skilled artisan will appreciate that the shape of the elastomeric dome 220 can be modified to achieve the desired tactile characteristics for the keyboard. Similar to the embodiment shown in FIG. 3, the elastomeric dome 220 of the embodiment shown in FIG. 6 also has a plunger 225 portion that does not contact the membrane 250 until the elastomeric dome 220 is in a collapsed state.

Figure 7:
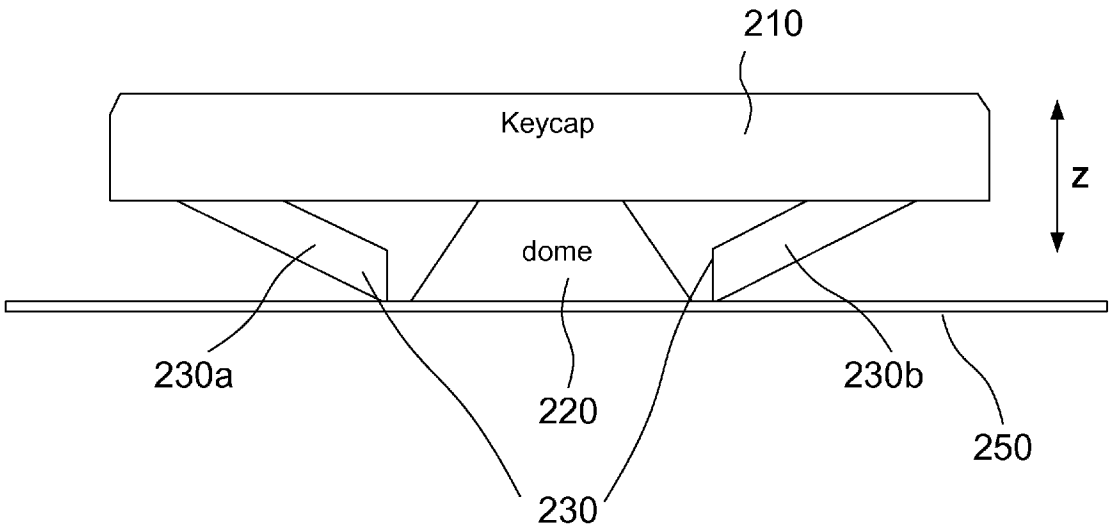
FIG. 7 is a simplified side view of an embodiment of the narrow key switch shown in FIG. 3.
Figure 8:
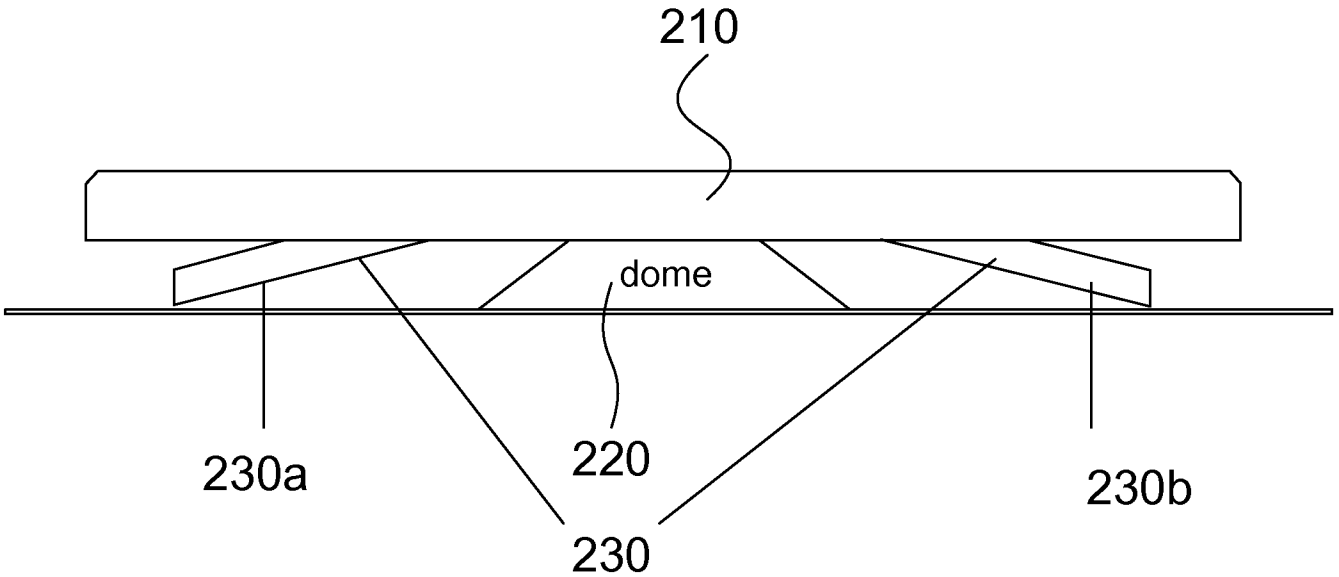
FIG. 8 is a side view of another embodiment of a narrow key switch.

FIG. 7 is a simplified side view of an embodiment of the narrow key switch 200 shown in FIG. 3. FIG. 8 is a side view of another embodiment of a narrow key switch 200 of a scissor-switch keyboard having an elastomeric dome underneath a key cap 210. The embodiment shown in FIG. 8 is similar to the on shown in FIG. 7, but the linkage structures 230*a*, 230*b* of the scissor mechanism 230 have a different orientation. As shown in FIG. 8, the linkage structures 203*a*, 230*b* are engaged with the base plate 270 on the outer lateral portions, on the ends closer to the outer peripheral edges of the key as opposed to the center. It is believed that the orientation of the linkage structures 230*a*, 230*b* shown in FIG. 7 is more stable than that of FIG. 8.

Figure 9:
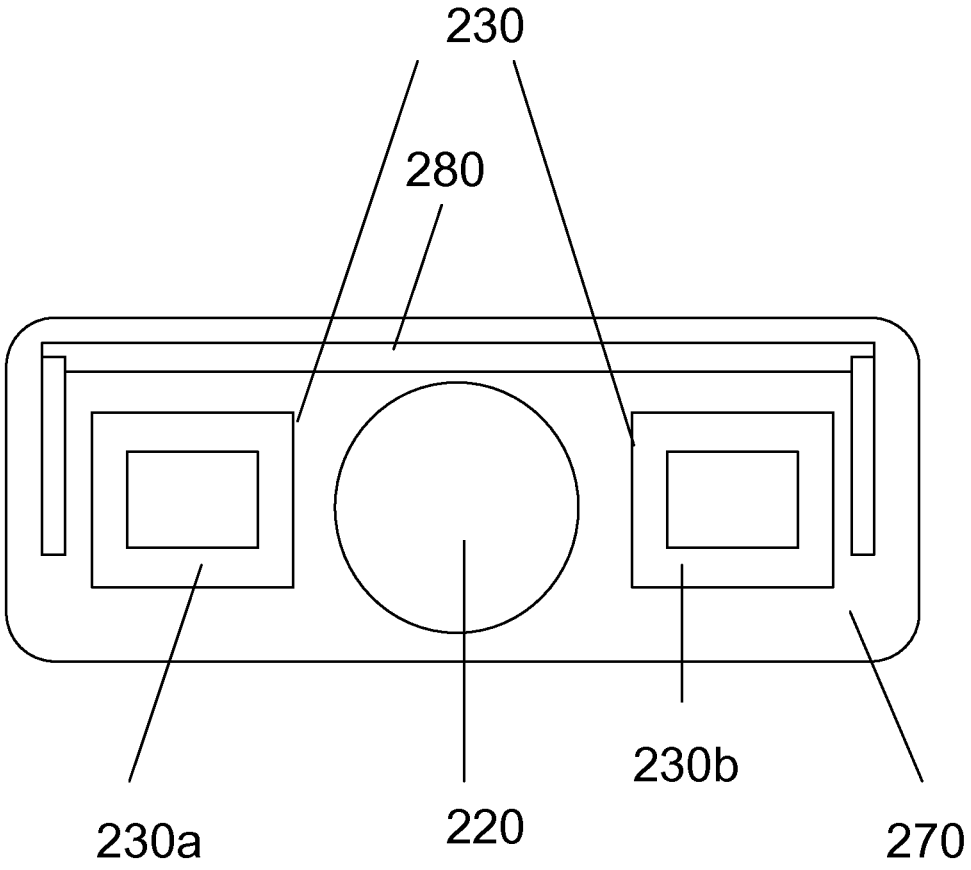
FIG. 9 is a simplified top plan view of an embodiment of a key switch with the key cap removed.

FIG. 9 is a simplified top plan view of an embodiment of a key switch 200 with the key cap 210 removed. As described above with reference to FIGS. 4 and 5, a link bar 280 can be included to provide additional stability as well as to transfer the load to the center of the key if the key is depressed on a side instead of the center. As will be appreciated by the skilled artisan, the load should be in the center of the key in order for the elastomeric dome 220 to be properly compressed. Thus, the link bar 280 helps to transfer the load to the center even if the key is depressed on a side. As shown in FIG. 9, the linkage structures 230*a*, 230*b* have a substantially square or rectangular shape when viewed from above.

Figure 10:
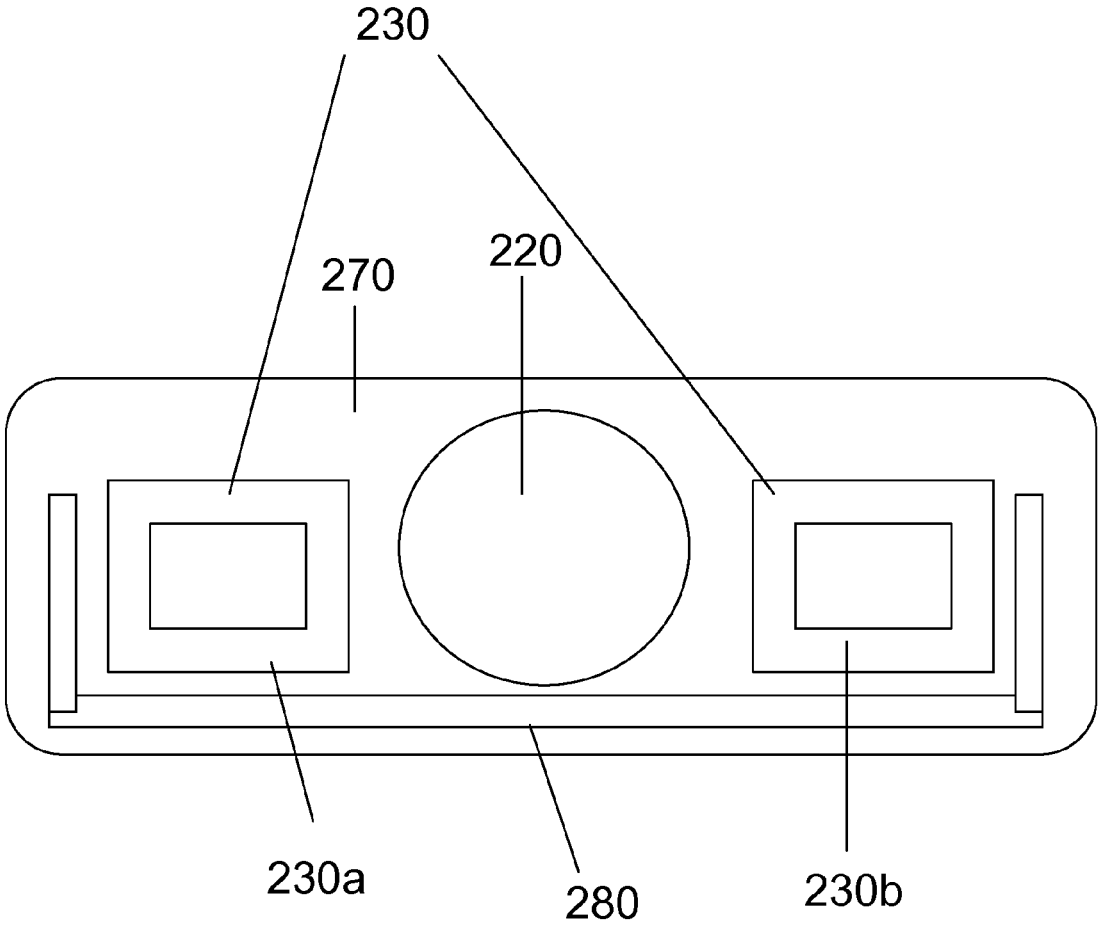
FIG. 10 is a simplified top plan view of another embodiment of a key switch, with the key cap removed.

FIG. 10 is a simplified top plan view of another embodiment of a key switch 200, with the key cap 210 removed. In this embodiment, the link bar 280 has a different orientation compared to the link bar 280 shown in FIG. 9.

Figure 11:
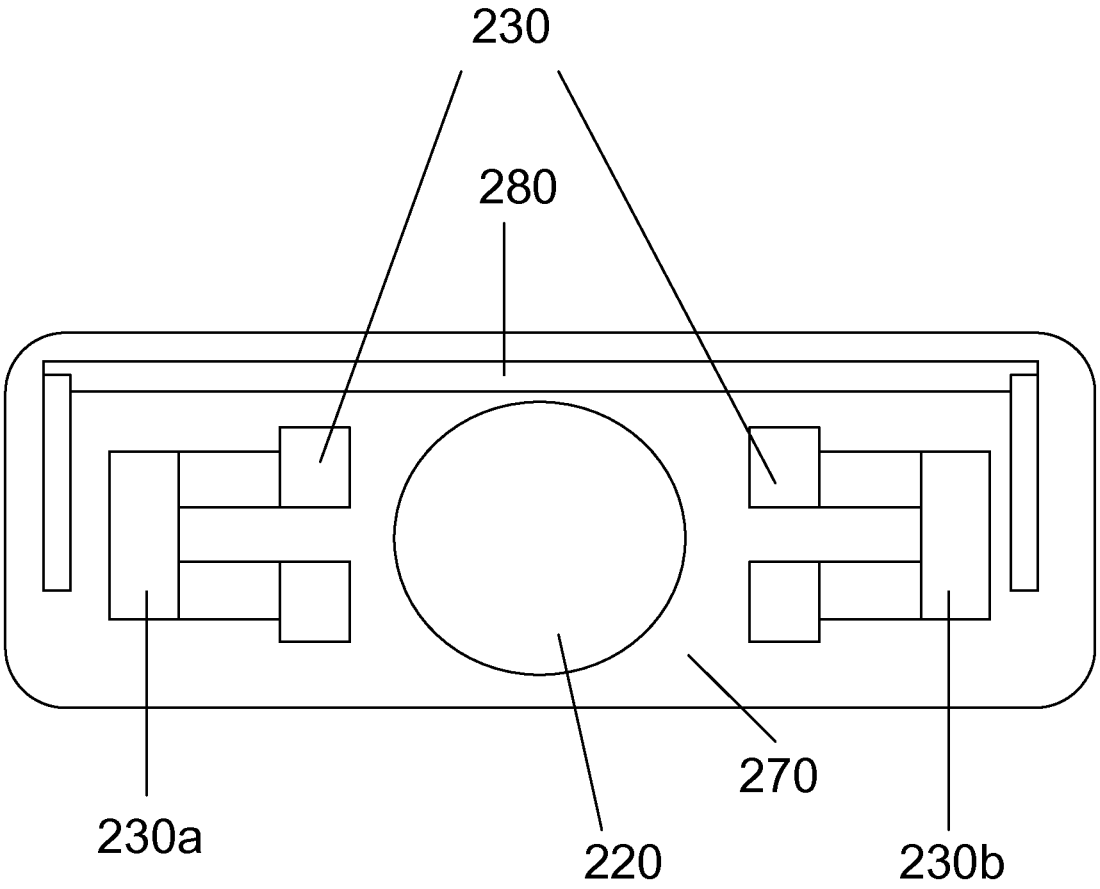
FIG. 11 is a simplified top plan view of yet another embodiment of a key switch, with the key cap removed.

FIG. 11 is a simplified top plan view of yet another embodiment of a key switch 200, with the key cap 210 removed. In this embodiment, the linkage structures 230*a*, 230*b* have an open end on the end where they engage with the base plate 270. It will be understood that the orientation of the linkage structures 230*a*, 230*b* with the open end may be reversed. It will also be understood that the orientation of the link bar 280 may be reversed from the one illustrated in FIG. 11.

Figure 12:
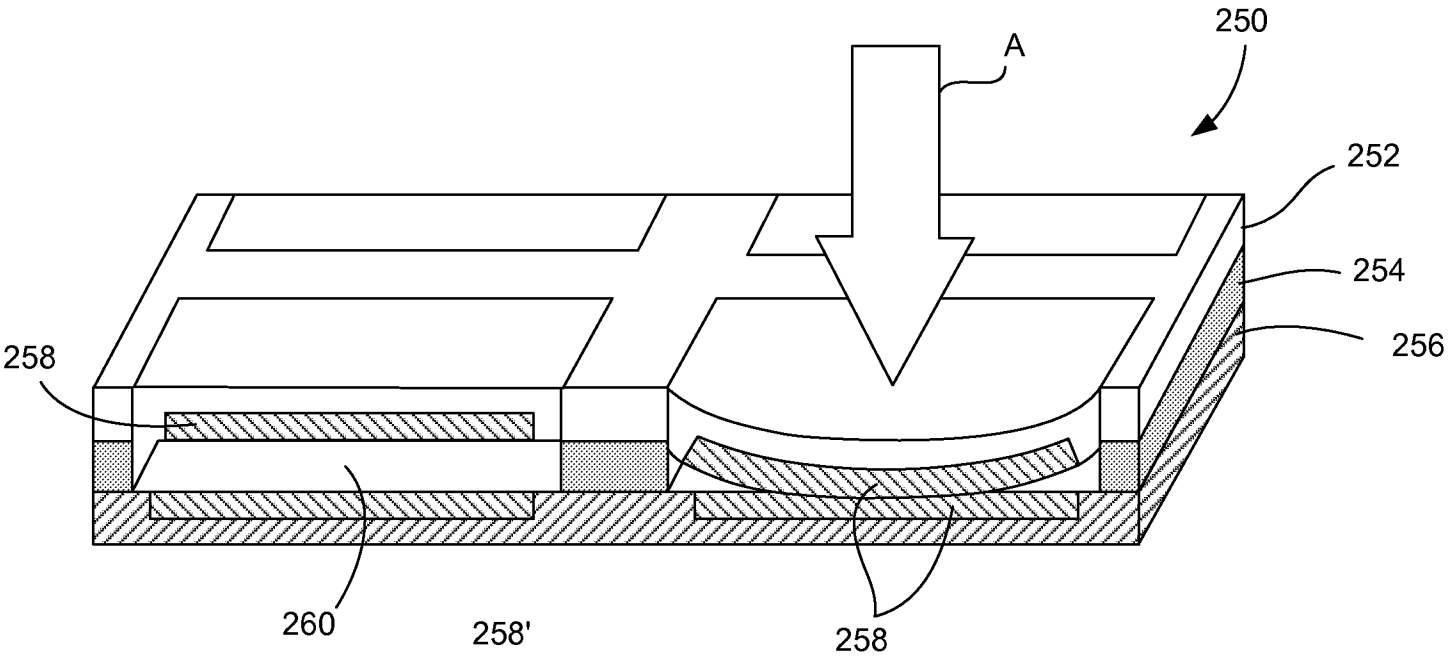
FIG. 12 is a detailed perspective view of an embodiment of a three-layer membrane of a printed circuit board.

FIG. 12 is a detailed perspective view of an embodiment of the membrane 250. According to an embodiment, the membrane 250 can have three layers, including a top layer 252, a bottom layer 256, and a spacer layer 254 positioned between the top layer 252 and the bottom layer 256. The top layer 252 and the bottom layer 256 can include conductive traces and their contact pads 258 on the underside of the top layer 252 and on the top side of the bottom layer 256, as shown in FIG. 12. The conductive traces and contact pads 258 can be formed of a metal, such as silver or copper. As illustrated in FIG. 8, the membrane sheet of the spacer layer 254 includes voids 260 to allow the top layer 252 to contact the bottom layer 256 when the elastomeric dome 220 is collapsed. According to an embodiment, the top layer 252 and bottom layer 256 can each have a thickness of about 0.075 μm. The spacer layer 254 can have a thickness of about 0.05 μm. The membrane sheets forming the layers of the membrane 250 can be formed of a plastic material, such as polyethylene terephthalate (PET) polymer sheets. According to an embodiment, each PET polymer sheet can have a thickness in the range of about 0.025 mm to about 0.1 mm.

Under "normal" conditions when the key pad is not depressed by a user (as shown on the left side of FIG. 12), the switch is open because the contact pads 258 of the conductive traces are not in contact. However, when the top layer 252 is pressed down by the elastomeric dome 220 in the direction of arrow A (as shown on the right side of FIG. 12), the top layer 252 makes contact with the bottom layer 256. The contact pad 258 on the underside of the top layer 252 can then contact the contact pad 258 on the bottom layer 256, thereby allowing the current to flow. The switch is now "closed", and the computing device can then register a key press, and input a character or perform some other operation. It will be understood that other types of switch circuitry can be used instead of the three-layer membrane 250 described above.

Figure 13:
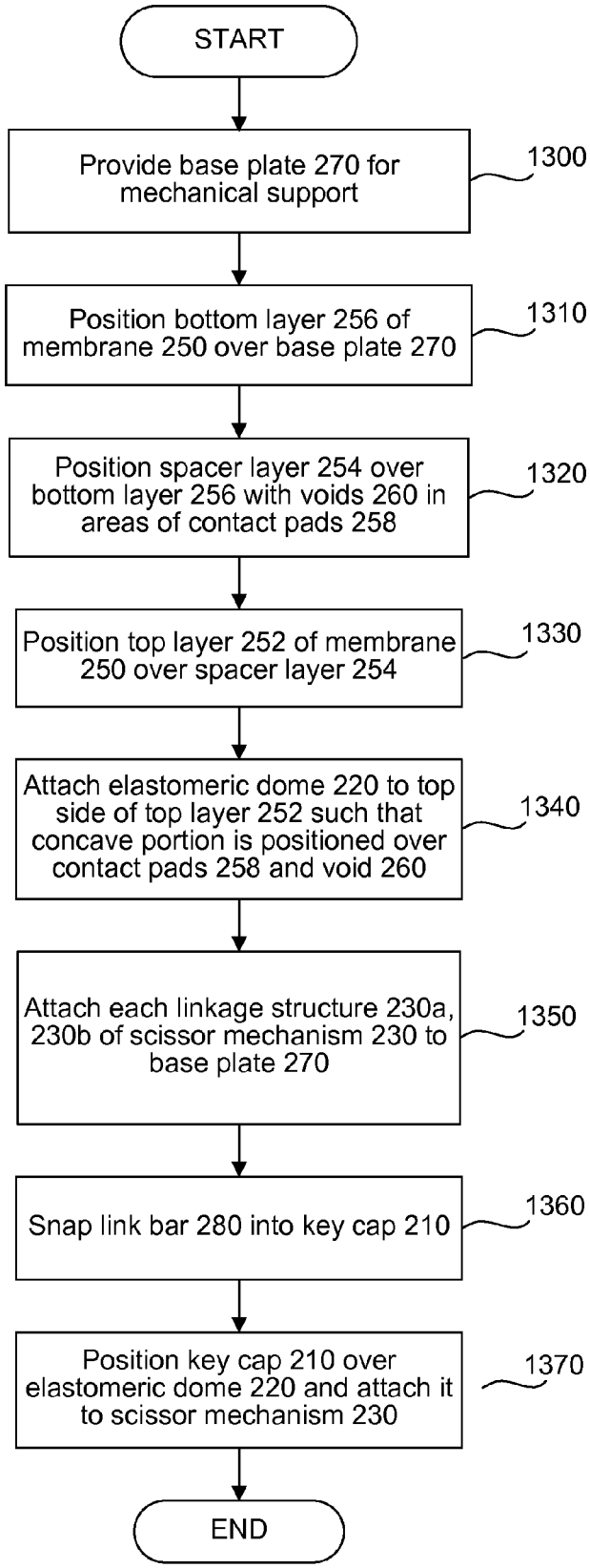
FIG. 13 is a flow chart of a method of assembling an embodiment of a narrow key switch.

A process for assembling the narrow key switch 200 will be described with reference to FIG. 13. A process for assembling the components of the key switch 200 will be described below with reference to steps 1300-1370. In step 1300, a base plate 270 is provided for mechanical support for the PCB as well as the entire key switch 200. In one embodiment, the base plate 270 is formed of stainless steel. In other embodiments, the base plate 270 can be formed of aluminum. According to an embodiment, the base plate 260 has a thickness in a range of about 0.2 mm to about 0.5 mm.

A process for forming the three-layer membrane 250 on the base plate 270 will be described below with reference to steps 1310-1330. In step 1310, the bottom layer 256 of the membrane 250 can be positioned over the base plate 270. Next, in step 1320, the spacer layer 254 can be positioned over the bottom layer 256 such that the voids 260 are in the areas of the contact pads 258. In step 1330, the top layer 252 can be positioned over the spacer layer 254 such that the contact pads 258 on the underside of the top layer 252 are positioned directly over the contact pads 258 on top side of the bottom layer 256 so that they can contact each other when the metal dome 240 is deformed. The layers 252, 254, 256 can be laminated together with adhesive. It will be understood that steps 1310-1330 can be combined into a single step by providing a three-layer membrane 250 that is pre-assembled or pre-laminated. The membrane 250 is positioned over the base plate 270 and held in place by one or more other components of the key switch 200, such as the scissor mechanism 230.

According to this embodiment, in step 1340, the elastomeric dome 220 can be attached to the top side of the top layer 252 of the membrane 250 such that the concave dome portion is positioned over the contact pads 258 and the void 260. In step 1350, each linkage structure 230*a*, 230*b* of the scissor mechanism 230 is then attached to the base plate 270. A link bar 280 can then be snapped into the key cap 210 in step 1360 such that the link bar 280 is rotatably engaged with the key cap. In step 1370, to complete the key switch 200, the key cap 210 is positioned over the elastomeric dome 220 and the scissor mechanism 230, and engaged with the scissor mechanism 230. The scissor mechanism 230 can be rotatably engaged with the key cap 210 by snapping the linkage structures 230*a*, 230*b* into features, such as grooves, on the underside of the key cap 210.

The advantages of the invention are numerous. Different aspects, embodiments or implementations may yield one or more of the following advantages. One advantage of the invention is that a low-travel keyboard may be provided for a thin-profile computing device without compromising the tactile feel of the keyboard.

The many features and advantages of the described embodiments are apparent from the written description and, thus, it is intended by the appended claims to cover such features and advantages. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A key switch for an electronic device, comprising:

a membrane disposed over a top surface of a base plate, the membrane including electrical switch circuitry; an elastomeric dome secured to the membrane, the elastomeric dome configured to deform to activate the electrical switch circuitry; two separate linkage structures each adjacent the elastomeric dome, wherein an upper end of each linkage structure is rotatably secured to an underside of a key cap positioned over the elastomeric dome and a lower end of each linkage structure is slidably secured to the top surface of the base plate, wherein the lower ends of the linkage structures are positioned adjacent to a center of the key cap and the upper ends of the linkage structures are positioned adjacent to the sides of the key cap such that the lower ends of the linkage structures slide toward the elastomeric dome; and a link bar rotatably secured to the underside of the key cap with each end of the link bar slidably secured to the top surface of the base plate, wherein the link bar is positioned around an outer periphery of the dome and an outer periphery of the linkage structures and the link bar has a length that spans substantially a length of the key cap to transfer a load from one side of the key cap to a center of the key cap when the key cap is depressed.

2. The key switch as in claim 1, further comprising stoppers on the top surface of the base plate to stop the sliding of the lower ends of the two separate linkage structures.

3. The key switch as in claim 1, wherein the upper end of each linkage structure is snapped into a feature disposed on the underside of the key cap and the lower end of each linkage structure is secured with a hook-shaped structure disposed on the top surface of the base plate, the hook-shaped structures defining a resting position for the linkage structures when the key switch is in a relaxed state.

4. The key switch as in claim 3, wherein the features comprise grooves.

5. The key switch as in claim 1, wherein the link bar snaps into features disposed on the underside of the key cap and each end of the link bar is secured to hooks disposed on the top surface of the base plate.

6. The key switch as in claim 1, wherein the electronic device comprises a keyboard.

7. The key switch as in claim 6, wherein the key switch comprises a space bar on the keyboard.

8. A key switch for an electronic device, comprising:

a membrane disposed over a top surface of a base plate, the membrane including a top layer having a first contact attached to an underside of the top layer, a bottom layer having a second contact attached to a top side of the bottom layer, and a spacer layer between the top and bottom layers and having a void between the first and second contacts; an elastomeric dome secured to the membrane and configured to deform when a key cap positioned over the elastomeric dome is depressed, the elastomeric dome including a plunger portion extending downward toward the membrane, the plunger portion contacting and pushing down on the top layer of the membrane to connect the first and second contacts to each other when the key cap is depressed; two separate linkage structures adjacent to the elastomeric dome and positioned on opposite sides of the elastomeric dome, wherein an upper end of each linkage structure is rotatably secured to an underside of the key cap and a lower end of each linkage structure is slidably secured to the top surface of the base plate and the lower ends of the linkage structures are oriented to slide on the top surface of the base plate in opposing directions along a first axis, wherein the lower ends of the linkage structures are positioned adjacent to a center of the key cap and the upper ends of the linkage structures are positioned adjacent to the sides of the key cap such that the lower ends of the linkage structures slide toward the elastomeric dome; and a link bar rotatably secured to an underside of the key cap with each end of the link bar slidably secured to the top surface of the base plate, wherein the ends of the link bar are oriented to slide on the top surface of the base plate in the same direction along second and third axes that are perpendicular to the first axis, and wherein the link bar is positioned around the outer periphery of the dome and an outer periphery of the linkage structures and the link bar has a length that spans substantially a length of the key cap to provide stability in the longitudinal direction by transferring a load from one side of the key cap to a center of the key cap when the key cap is depressed.

9. The key switch as in claim 8, further comprising stoppers on the top surface of the base plate to stop the sliding of the lower ends of the two separate linkage structures.

10. The key switch as in claim 8, wherein the upper end of each linkage structure is snapped into a feature disposed on the underside of the key cap and the lower end of each linkage structure is secured with a hook-shaped structure disposed on the top surface of the base plate, the hook-shaped structures defining a resting position for the linkage structures when the key switch is in a relaxed state.

11. The key switch as in claim 10, wherein the features comprise grooves.

12. The key switch as in claim 8, wherein the link bar is snapped into features disposed on the underside of the key cap and each end of the link bar is secured to hooks disposed on the top surface of the base plate.

13. The key switch as in claim 8, wherein the electronic device comprises a keyboard and the key switch a space bar.

14. A keyboard, comprising: a plurality of key switches, at least one key switch comprising: an elastomeric dome secured to a membrane that includes electrical switch circuitry, the elastomeric dome configured to deform to activate the electrical switch circuitry; a key cap positioned over the elastomeric dome and two separate linkage structures positioned on opposite sides of the elastomeric dome, wherein an upper end of each linkage structure is secured in a feature on an underside of the key cap and a lower end of each linkage structure is slidably secured to a structure on a top surface of a base plate, wherein the lower ends of the linkage structures are positioned adjacent to a center of the key cap and the upper ends of the linkage structures are positioned adjacent to the sides of the key cap such that the lower ends of the linkage structures slide toward the elastomeric dome; and a link bar secured to at least one feature on the underside of the key cap and each end of the link bar slidably secured to a structure on the top surface of the base plate, wherein the link bar is positioned around an outer periphery of the dome and an outer periphery of the linkage structures and the link bar has a length that spans substantially a length of the key cap to transfer a load from one side of the key cap to a center of the key cap when the key cap is depressed, and wherein the linkage structures are oriented such that the lower ends of the linkage structures slide on the top surface of the base plate in opposing directions along a first axis and the link bar is oriented such that the ends of the link bar slide on the top surface of the base plate along second and third axes that are different from the first axis.

* * * * *